United States Patent [19]

Marcoux

[11] Patent Number: 4,670,752

[45] Date of Patent: Jun. 2, 1987

[54] HARD-WIRED CIRCUIT FOR HANDLING SCREEN WINDOWS

[75] Inventor: Guy Marcoux, Le Plessis Trevise, France

[73] Assignee: Compagnie Generale d'Electricite, Paris, France

[21] Appl. No.: 702,567

[22] Filed: Feb. 19, 1985

[30] Foreign Application Priority Data

Feb. 20, 1984 [FR] France ..... 84 02510

[51] Int. Cl.[4] ..... G09G 1/14

[52] U.S. Cl. ..... 340/721; 340/744; 340/724; 340/747

[58] Field of Search ..... 340/721, 724, 744, 747, 340/750

[56] References Cited

U.S. PATENT DOCUMENTS

| | | | |
|---|---|---|---|
| 4,197,590 | 4/1980 | Sukonick et al. | 340/721 |
| 4,295,135 | 10/1981 | Sukonick | 340/731 |
| 4,533,910 | 8/1985 | Sukonick et al. | 340/721 |
| 4,542,376 | 9/1985 | Bass et al. | 340/721 |
| 4,554,538 | 11/1985 | Bieneman | 340/721 |

FOREIGN PATENT DOCUMENTS 2517448 11/1982 France .

*Primary Examiner*—Gerald L. Brigance
*Assistant Examiner*—Jeffery A. Brier
*Attorney, Agent, or Firm*—Sughrue, Mion, Zinn, Macpeak & Seas

[57] ABSTRACT

The window handler circuit is inserted between an image memory (7) having as many pages as there are possible windows and a screen controller capable of reading from any of the pages of the image memory. The handler comprises two auxiliary memories (3, 4) each of which stores bit maps in which a logic one bit indicates that the corresponding window includes an image element in the same line or the same column as the case may be as the screen position currently being scanned. A battery (5) of AND gates receives the line and column bit maps associated with the current screen position and generates a third bit map in which each logic one bit indicates that the corresponding window includes an image element at the current screen position. A priority encoder (6) then selects the visible or "uppermost" window from the said third bit map by generating the number (N) of the page to be read in the image memory (7). Relatively little memory is dedicated to determining the uppermost window at any screen position, since a two-dimensional array (the window bit map for each screen position) is generated from two one-dimensional arrays.

5 Claims, 5 Drawing Figures

SCREEN CONTROLLER
10
X
Y
E
10
Y'
7
V-AXIS PROJEC-TION RAM 128×8
12
7
X
X- AXIS 128×8 PROJECTION RAM
11
13
PRIORITY ENCODER
14
N
17
18
μP
15
Y
X

HARD-WIRED CIRCUIT FOR HANDLING SCREEN WINDOWS

The present invention relates to graphics or alphanumeric displays using TV type point scanning and for an information processing system, and more particularly to a multi-window display capable of displaying independent rectangular and possibly overlapping image areas on a screen.

BACKGROUND OF THE INVENTION

Generally speaking, presently existing display devices use a screen controller including a processor (which may be a dedicated processor) for generating signals to refresh a display of an image (which may be displayable in full or in part) by scanning along lines of successive character or point positions while simultaneously reading an image at each point or character position. The memory is read by means of an address word having one group of bits that is a function of the column number of the current point or character position along the current scan line, and another group of bits which is a function of the row number of the current line in a scan frame.

In most window display devices, the screen controller does not directly address the image memory per se when refreshing the display, but rather it addresses a "paste-up" memory in which another processor (or sven the screen controlling processor it self) has assembled the various "visible" portions of the image (i.e. the portions that are to appear in each window) by using fairly complex software to select the visible portions only from the total contents of the image memory per se.

The paste-up memory may store aspect words defining the image pattern at each point or character position. This is often true of display terminals for the image memory per se is located in a central computer which handles the contents of the paste-up memory by remote control, leaving the screen controller with the sole function of refreshing the display. This disposition has the drawback of reducing terminal independence and of monopolizing much of the memory capacity and processing time of the central computer.

One known way of giving more independence to a window display system, is to simplify the handling of the paste-up memory by splitting the screen and the displayable image into a relatively small number of unit blocks of equal size. The paste-up memory is then a small capacity memory limited to storing a single word for each unit block. This word defines the window which is to be visible in the corresponding block, and generally also defines which portion of that window is to be displayed. In either case, the screen controller uses these words to index its addressing of the image memory per se in such a manner as to read the appropriate aspect words for displaying the desired portion of the desired window. This disposition has the drawback of limiting the choice of windows in the displayable image to windows build up from unalterable unit blocks.

Preferred embodiments of the present invention remedy the above defects by means of a simply-constructed hard-wired circuit which continuously indicates the window to which the character or point position currently being refreshed belongs, and without imposing restrictions on window definition.

SUMMARY OF THE INVENTION

The present invention provides a hard-wired screen window handler circuit for insertion between an image memory and a screen controller, the image memory being organized in as many pages as there are possible windows, with each page corresponding to a particular window and storing aspect words relating to point or character positions of a document to be displayed in full or in part in the corresponding window on the screen, and the screen controller generating a signal for refreshing the screen display by scanning lines of successive point or character positions while simultaneous reading from any one of the pages in the image memory by means of an address word including an X-axis group of bits having a value which is a function of the column number of the current point or character position along a scan line and a Y-axis group of bits having a value which is a function of the line number of the current line in the scan, wherein the handler comprises:

two auxiliary memories, one being a window X-axis projection memory which is addressed by at least the more significant portion of the X-axis group of bits and which stores for each of the resulting possible X-axis addressing values a window X-axis occupation word indicating which of the windows include any point or character positions occupying the column of the screen which is addressed by the said portion of the X-axis group of bits, the other being a window Y-axis projection memory which is addressed by at least the more significant portion of the Y-axis group of bits and which stores for each of the resulting possible Y-axis addressing values a window Y-axis occupation word indicating which of the windows include any point or character positions occupying the line of the screen which is addressed by the said portion of the Y-axis group of bits;

intersection logic means connected to receive the window X-axis and Y-axis occupation words to generate a third occupation word indicating which of the windows include the point or character position currently being scanned by the screen controller; and a priority encoder determining an order of window superposition and connected to receive the said third occupation word to deliver a number representative of the window which is to be displayed at the currently scanned screen position, said number being used to select a particular page of the image memory to be read by means of the address word generated by the screen controller.

In this hard-wired window handler, the memory capacity dedicated to pasting-up windows on the screen is reduced by identifying windows by their projections on two cartesian coordinates defined by the display refresh scan rather than by identifying windows by labelling units of area. It is thus perfectly feasible for window positions to be defined to within the scan resolution without requiring a paste-up memory of excessive capacity.

BRIEF DESCRIPTION OF THE DRAWINGS

Embodiments of the invention is described by way of example with reference to the accompanying drawings, in which.

MORE DETAILED DESCRIPTION

Figure 1:
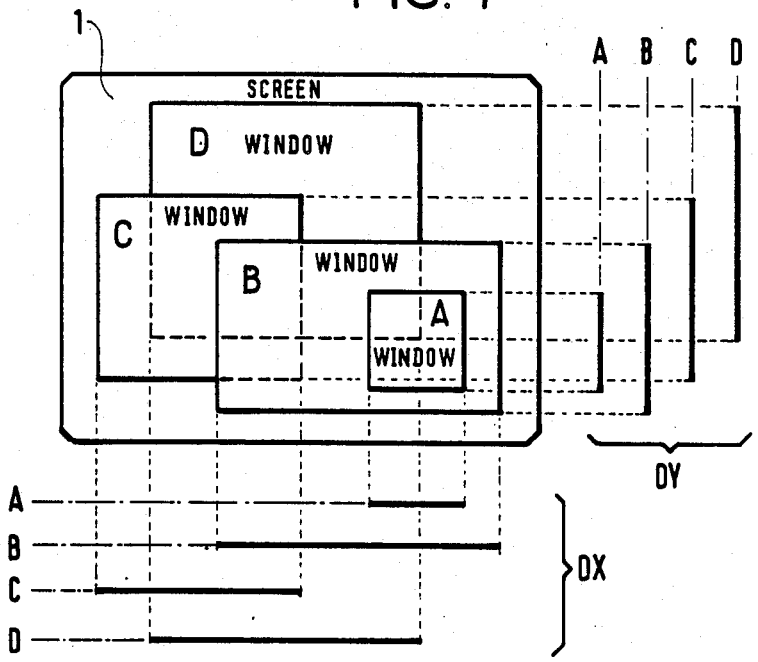
FIG. 1 is a diagram showing the placement of windows on a display screen.

In graphics display devices, a screen controller uses a line scanning technique to write to point positions on the screen one by one. The information written at each point is determined by the value of an aspect word stored in an image memory and attributed to a particular point position. The relevant aspect word is addressed by the screen controller by means of an address word which is a function of the current point on the screen as defined by the scanning processes. In particular, the address word includes an X-axis group of bits representing (to a suitable degree of accuracy) the column number of the current point along the scan line, and a Y-axis group of bits similarly representing (to a suitable degree of accuracy) the line number of the current scan line in the scan frame. In most graphics display devices, it is common practice to reduce the rate at which the image memory is read by ensuring that each directly addressable image memory location combines a plurality of aspect words relating to successive points along a scan line. This leads to the screen controller simultaneously reading all of the aspect words stored in the same location and then re-establishing the necessary synchronization between said aspect words and the point-by-point screen scan, for example by using a parallel-in and serial-out shift register. This leads to the X-axis group of bits in an address word for addressing the image memory being limited in resolution to the group column number of the adjacent aspect words, only one of which is relevant to the current point.

In alphanumerical display devices, the image memory merely stores a character code which defines a pattern to be displayed on a screen cell constituted by a plurality of adjacent points, e.g. a matrix of $8\times8$ points. In this case, the X-axis group of bits in the image memory address word is limited in resolution to the cell column number along a scan line, while the Y-axis group of bits is limited in resolution to the cell line number in the frame. Additional addressing within the cell matrix is applied to a character memory as a function of the character code read in the image memory. In all cases, the screen controller generates an address for application to the image memory and corresponding to the YY co-ordinates in the screen scan of very small zones of the screen which are scanned successively. These zones may be point positions, or groups of adjacent aligned point positions, or cells, and they represent the smallest possible screen partition which can be used for defining window positions. Such minimum zones for possible screen partitioning are referred to herein as "image elements".

The screen controller serves to display on the screen all or a part of a particular document defined in the image memory in terms of aspect words relating to the image elements of the document. Screen windows are used to simultaneously display a plurality of different documents, at least in part. Each window is attributed to a particular document, and displays that document in full or in part. This requires the image memory to be subdivided into pages, each of which stores the aspect words relating to the image elements of a given document, and further requires the address words generated by the screen controller to include extra bits defining the relevant page, i.e. the page storing the document which corresponds to the window currently being scanned on the screen.

FIG. 1 shows a screen 1 defined by image elements referenced by XY cartesian co-ordinates which appear, as mentioned above, in the address word generated by the screen controller. The screen 1 has rectangular windows A, B, C, D which are disposed parallel to the sides of the screen and which are of various sizes. These windows are fully determined by their projections DX, DY on the two co-ordinate axes defined by the display refresh line scan performed by the screen controller.

At any instant it is possible to determine the window to which the currently scanned image element belongs on the basis of the window projections DX, DY and on the basis of the order in which they are superposed on the screen (alphabetic order of their reference letters in this case). The window to which an image element belongs is deduced firstly by determining which windows have projections DX and DY that simultaneously overlap the corresponding X-axis and Y-axis portions of the address word generated by the screen controller, and then by removing any ambiguity resulting from an image element simultaneously belonging to more than one screen window by considering the windows in an order of priority which defines the order in which they are superposed.

Figure 2:
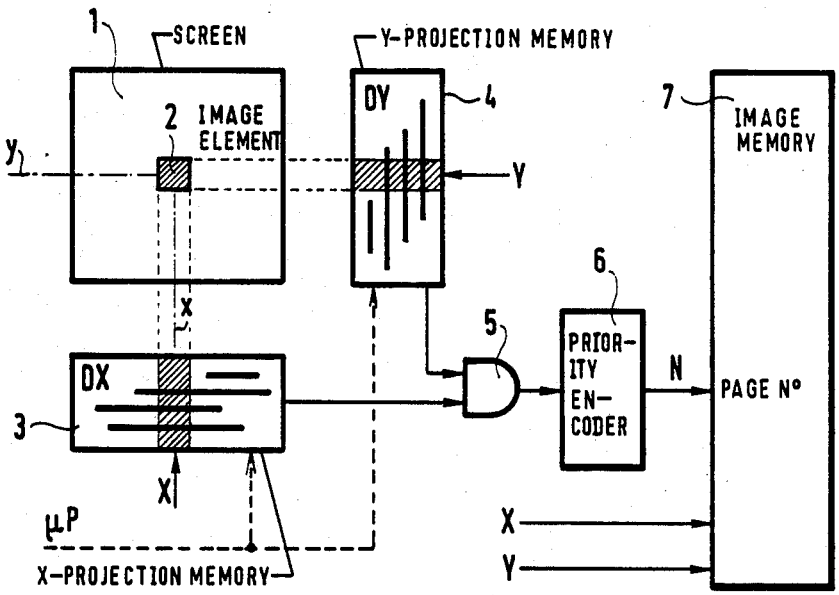
FIG. 2 is a diagram of a window handler circuit of a first embodiment of the invention.

FIG. 2 is a diagram of the resulting structure of a window handler ciruit for providing the extra window-defining bits to be included in the screen image addressing word as generated by the screen controller. The figure shows the screen 1 and the image element 2 currently being scanned by the display refresh scan, which element is defined by the screen controller generating an address word having an X-axis portion of value x and a Y-axis portion of value y. An auxiliary X-axis window projection memory 3 stores the window projections DX on the X-axis. This memory is addressed by the X-axis group of bits in the screen controller address word, and has one addressable location for each discrete value which the X-axis group of bits is capable of assuming. Each of its locations stores a bit map having one bit per window (4 in this case) such that a 1 value bit indicates that the corresponding window projects onto the value x in question, and a 0 value bit indicates that the corresponding window does not project onto the value x. An auxiliary Y-axis window projection memory 4 stores the window projections DY on the Y-axis in similar manner. This memory is addressed by the Y-axis group of bits in the screen controller address word, and has one addressable location for each discrete value which the Y-axis group of bits is capable of assuming. Each of its locations stores a bit map having one bit per window (4 in this case) such that a 1 value bit indicates that the corresponding window projects onto the value y in question, and a 0 value bit indicates that the corresponding window does not project on the value y.

The bits from the two bit maps output by the auxiliary memories 3 and 4 and representing the projections of the windows on the X and Y axes respectively are applied in corresponding pairs to a battery 5 of two-input logic AND gates to provide a third bit map in which a logic level 1 indicates that the corresponding window overlaps the currently scanned image element, and a logic level 0 indicates that it does not.

A priority encoder 6 is connected to the outputs from the battery 5 of logic AND gates so as to give priority to the window which is "uppermost" in the order of window super-positioning. The output from the priority encoder 6 is a binary number N designating the window which is visible at the currently scanned image element. This number N is associated with the XY address word generated by the screen controller to address the appropriate page of the image memrory 7 in which the aspect words defining the document corresponding to the selected window are stored.

The contents of the auxiliary X-axis and Y-axis projection memories 3 and 4 are modified in between display refresh scan lines, e.g. during the frame flyback period between two successive images. This is done by an auxiliary microprocessor uP, which may be the same microprocessor as the screen controller. The capacity required for the auxiliary memories depends on the number of windows (bit map word length) and on the number of image element rows and columns (number of addressable words). This capacity may be reduced by omitting some of the less significant bits from the X-axis and/or Y-axis portions of the address word when addressing the auxiliary memories. This has the effect of making window positioning resolution coarser than the finest resolution which could theoretically be obtained with any given type of image element.

Figure 3:
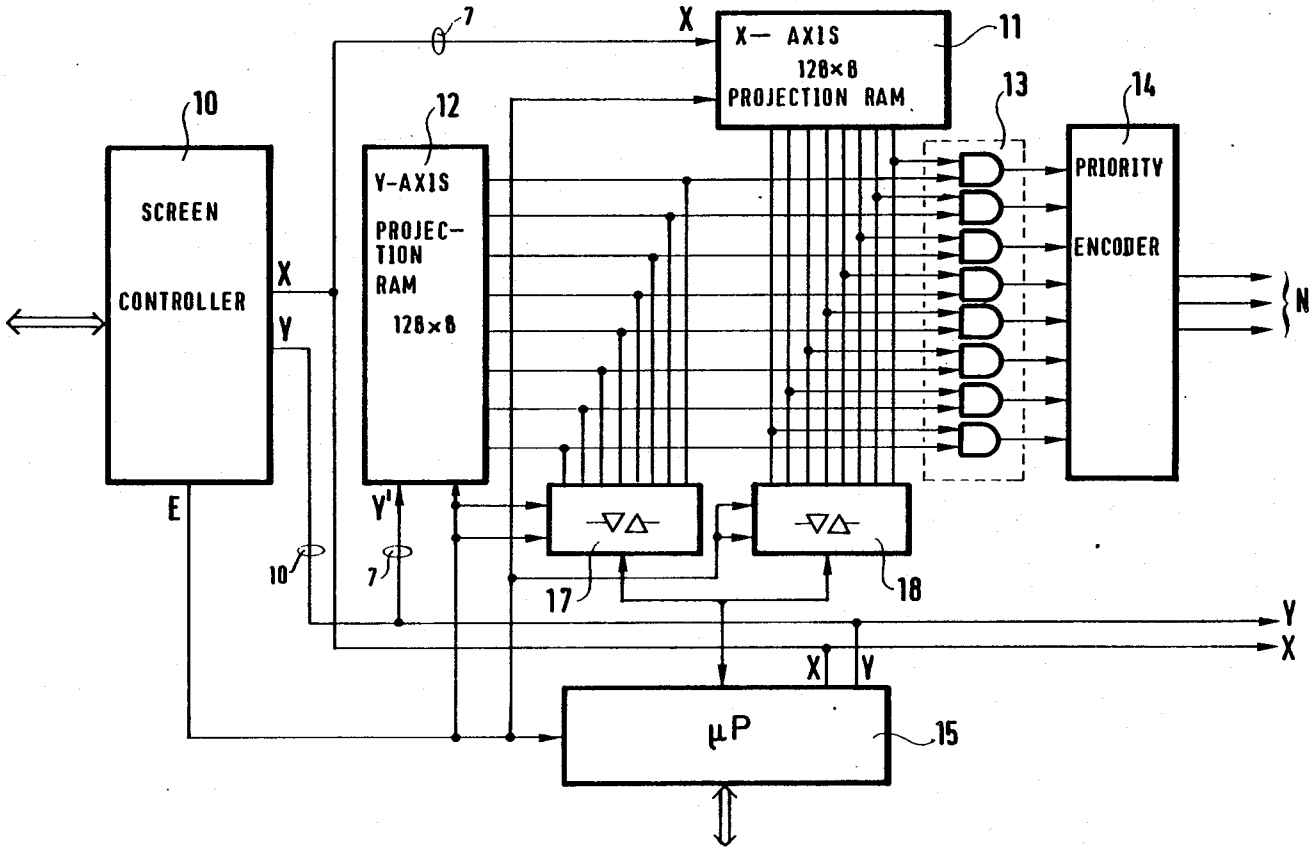
FIG. 3 is a more detailed diagram of the window handler circuit of the first embodiment of the invention.

FIG. 3 shows an embodiment of a window handler circuit for use with a screen having 1024×1024 point positions and a screen controller 10 generating a display refresh scan at 50 images per second. The addres words generated by the screen controller resolve the X-axis scan lines into groups of eight successive point positions and thus include an X-axis group having 7 bits, while its Y-axis groups have a full 10 bits. The screen controller also generates an address bus busy signal E indicating whether it is using its address bus or not. This window handler ciruit is intended to handle eight windows whose positions on the screen can be defined to the resolution of a cell having 8×8 point positions. The X-axis and Y-axis wind projection auxiliary memories 11 and 12 respectively are thus each constituted by 128 eight-bit words of random access memory (RAM). The X-axis auxiliary memory 11 is thus addressed by all seven bits of the X-axis group in each address word, while the Y-axis auxiliary memory 12 is addressed by the seven most significant bits Y' of the corresponding Y-axis group. A battery 13 of eight two-input logic AND gates is connected to receive corresponding window projection bits in pairs from the auxiliary memories 11 and 12, and a priority encoder 14 is connected to the outputs from the battery 13 to deliver the number N of the current window, which number N is included in the total address word N and XY by which the screen controller reads the image memory.

An auxiliary processor 15 has its address bus connected directly to the screen controller address bus, its data bus connected via buffer circuits 17 and 18 to the data ports of the auxiliary memories 11, 12, and its control bus connected to the write controls of the auxiliary memories, to the enable and direction controls of the buffer circuits, and to receive the bus busy signal E from the screen controller 10. When the address bus is not being used by the screen controller as indicated by the bus busy signal E, the processor 15 controls the contents of the auxiliary memories 11, 12, i.e. it controls the shapes and sizes of the windows.

Refreshing a screen having 1024×1024 point positions at 50 images per second, with the image memory being read in groups of eight successive point positions along a scan line, corresponds to the address word of the screen controller changing every 120 ns, during which time the screen controller and handler circuit must properly address the screen memory. This period is reasonable given the read times of normal RAM, provided that the delay caused by the window handler circuit is not subtracted from the image memory read time. Thus, the delay caused by the handler circuit should be compensated on application to the image memory by resynchronizing the XY address word together with the addition N from the priority encoder and the scan synchronizing signals from the screen controller.

The effect of ignoring the three least significant bits of the Y-axis group of bits in the address word from the screen controlled is to cause window resolution to be defined in terms of an 8×8 cell rather than in terms of an eight point position line segment. The size of such a cell is very small compared to the size of the screen, and the resulting limitation on window definition is insignificant.

The number of windows may be increased by enlarging the window handler circuit. For example, for 32 windows, the auxiliary memories 11 and 12 should each be constituted by 128 32-bit words, the battery 13 should have 32 AND gates, and four eight-bit priority encoders should be cascaded.

With a high number of windows and so long as the rate at which the address words are generated by the screen controller is not too high, the screen handler can designed to operate using a sequential technique operating in several successive steps during each screen controller addressing cycle, thereby reducing the number of gates in the battery 13 and the number of input lines to the priority encoder 14 and the buffer circuits 17 and 18.

Figure 4:
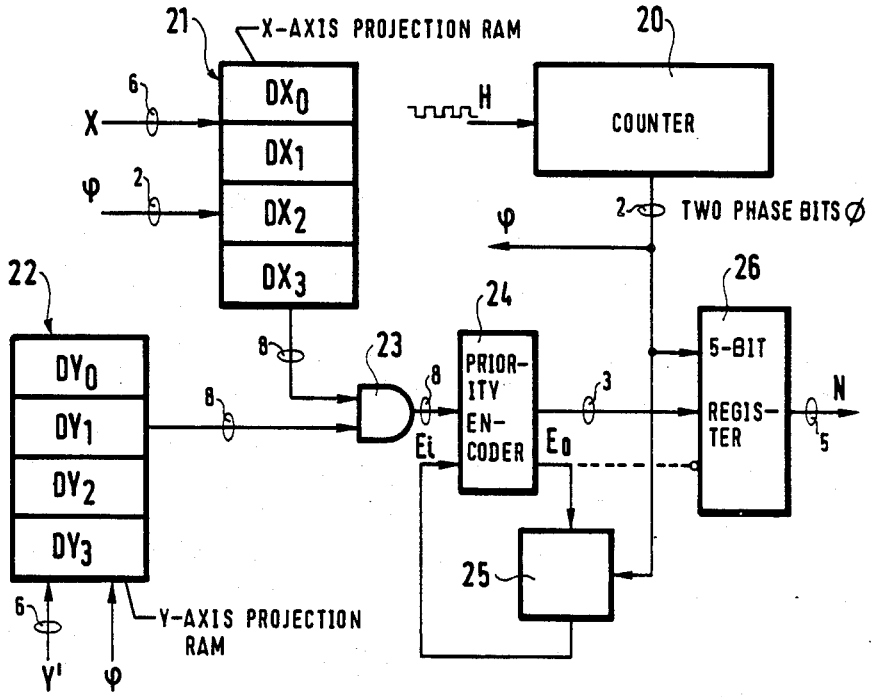
FIG. 4 is a block diagram of a window handler circuit of a second embodiment of the invention.

FIG. 4 is a diagram of a circuit for handling 32 windows for a screen having 512×512 point positions and with the display being refreshed at 50 images per second by means of a screen controller addressing the image memory in groups of 8 successive point positions along a scan line. The address word value thus changes once every 480 ns. As before, the windows handled by this circuit are positioned to the resolution of a grid of cells made up from 8×8 point positions, i.e. the three least significant bits of the Y-axis bits in the screen controller address word are ignored in window positioning. The window handler includes a counter 20 operating at four times the rate at which the XY address word generated by the screen controller changes. the counter delivers two step-defining bits $\phi$, one of which changes at said four times rate, and the other of which changes at half that rate. The X-axis auxiliary projection memory 21 has a capacity of 256 8-bit words. It is addressed by the two step bits 6 which divide it into four partitions each having 64 8-bit words, with each partition being addressed by means of the 6 bits of the X-axis portion of the screen controller address word. Similarly, the Y-axis auxiliary projection memory 22 has a capacity of 256 8-bit words. It is addressed by the two step bits $\phi$ which divide it into four partitions each having 64 8-bit words, with each partition being addressed by means of the 6 most significant bits of the Y-axis portion of the screen controller address word. The battery of two-input logic AND gates 23 connected to receive corresponding bits from both auxiliary memories still only comprises eight gates and the priority encoder 26 still only has eight inputs in spite of there being 32 windows. The encoder circuit is provided with an inhibit cirucit constituted by a bistable latch 25 inserted between its activation flag output EO and its inhibit input Ei. The latch 25 is reset to zero by the falling edges of the most significant step bit. A five bit parallel register 26 delivers the window number N on the basis of the step bits $\phi$ and of the three output bits from the priority encoder 24 which it stores in response to the activation flag EO from the priority encoder 24.

The window handler circuit determines which window belongs to the current image element being scanned by examining the projections DX, DY of the 32 windows in four successive groups of eight, at the rate of one group per step as defined by the step bits $\phi$, with the windows being considered in order of decreasing priority so that the first signal from the actiivation flag determines the only occasion on which the priority encoder is activated in any one cycle and also indicates the highest priority window. The five-bit parallel register delivers the selected window number on the basis of the number of the window within its group and the corresponding two step bits $\phi$ from the counter.

Figure 5:
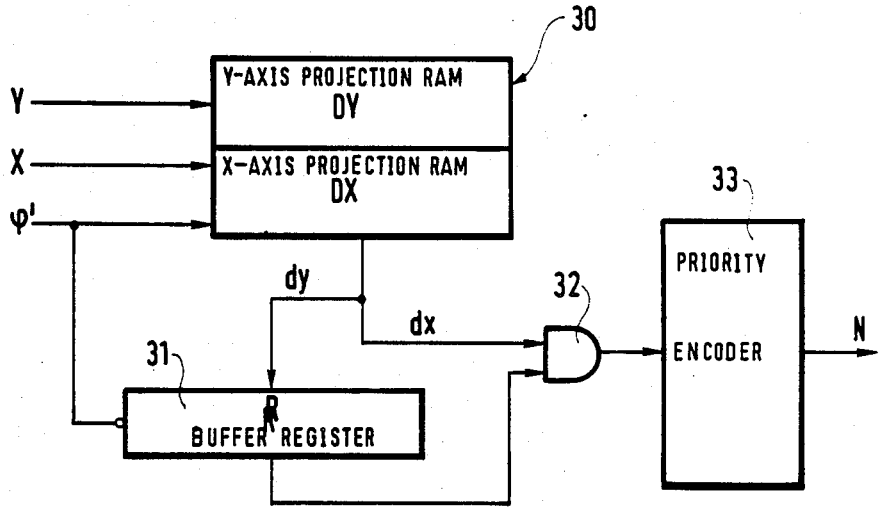
FIG. 5 is a block diagram of a third embodiment of a window handler circuit of the invention.

FIG. 5 shows a variant of the FIG. 3 window handler circuit. In this variant, the auxiliary X-axis and Y-axis projection memories are combined in a single RAM 30 which is addressed both by the X-axis group of bits and by the Y-axis group of bits from the screen controller address word. A buffer register 31 placed at the output from the RAM 30 serves to present the Y-axis projection bit map of the current image element to the battery of logic AND gates 32 simultaneously with its X-axis projection bit map. As before the priority encoder 33 connected to the outputs from the battery of logic gates 32 delivers the window number N.

The Y-axis projection bit map for each line is copied into the buffer register 31 at the beginning of each scan line and remains constant throughout that line. This transfer is performed under the control of a write signal $\phi'$ which is also used for addressing the DX or DY portions of the RAM 30.

This variant simplifies the auxiliary processor's access to the window handler circuit RAM 30.

The various embodiments described lend themselves to integration on a single LSI circuit (e.g. a prediffused circuit), thus reducing production costs, energy consumption and physical bulk.

I claim:

1. A hard-wired screen window handler circuit coupled between an image memory and a screen controller, the image memory being organized in as many pages as there are possible windows, with each page corresponding to a particular window and storing aspect words relating to point or character positions of a document to be displayed in full or in part in the corresponding window on the screen, and the screen controller generating a signal for refreshing a screen display by scanning lines of successive point or character positions while simultaneous reading from any one of the pages in the image memory by means of an address word including an X-axis group of bits having a value which is a function of a column number of a current point or character position along a scan line and a Y-axis group of bits having a value which is a function of a line number of a current line in the scan, wherein the handler comprises:

two auxiliary memories, one being a window X-axis projection memory which is addressed by at least a more significant portion of an X-axis group of bits and which stores for each of the resulting possible X-axis addressing values a window X-axis occupation word indicating which of the windows include any point or character positions occupying the column of the screen which is addressed by the said portion of the X-axis group of bits, the other being a window Y-axis projection memory which is addressed by at least a more significant portion of a Y-axis group of bits and which stores for each of the resulting possible Y-axis addressing values a window Y-axis occupation word indicating which of the windows include any point or character positions occupying the line of the screen which is addressed by the said portion of the Y-axis group of bits;

intersection logic means connected to receive the window X-axis and Y-axis occupation words to generate a third occupation word indicating which of the windows include the point or character position currently being scanned by the screen controller; and a priority encoder determining an order of window superposition and connected to receive the said third occupation word to deliver a number representative of the window which is to be displayed at the currently scanned screen position, said number being used to select a particular page of the image memory to be read by means of the address word generated by the screen controller.

2. A circuit according to claim 1, wherein the window X-axis and Y-axis projection occupation words are both bit maps with each bit position corresponding to a particular window and with a logic 1 value in any bit position indicating that the corresponding window includes a character or point position in the same line or column as the case may be as the currently scanned screen position, and wherein the intersection means is constituted by a battery of two-input AND gates each corresponding to a respective one of the windows and each having its two imputs connected to receive a respective one of the bit map bits relating to that window.

3. A circuit according to claim 1, wherein the said auxiliary memories are constituted by distinct banks of RAM having separate data outputs.

4. A circuit according to claim 1, whrein the said auxiliary memories are constituted by separate partitions of a single bank of RAM, and including a buffer register for applying one of the said projection occupation words to the said intersection logic means at the same time as the other projection occupation word is applied from the said RAM.

5. A circuit according to claim 1, wherein the windows are split into groups and the auxiliary memories are partitioned into as many zones as there are groups of windows, said zones being interrogated sequentially by means of step bits delivered by a counter which cycles once through all of the zones in a time between changes in the screen controller address word.

* * * * *